US010725410B2

(12) United States Patent
Yamanaka

(10) Patent No.: US 10,725,410 B2
(45) Date of Patent: Jul. 28, 2020

(54) IMAGE FORMING APPARATUS CHANGING PRODUCTIVITY ACCORDING TO DISCHARGED SHEET NUMBER

(71) Applicant: CANON KABUSHIKI KAISHA, Tokyo (JP)

(72) Inventor: Shinichi Yamanaka, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/159,993

(22) Filed: Oct. 15, 2018

(65) Prior Publication Data

US 2019/0113870 A1 Apr. 18, 2019

(30) Foreign Application Priority Data

Oct. 18, 2017 (JP) ..... 2017-201952

(51) Int. Cl.
*G03G 15/00* (2006.01)
*B65H 43/06* (2006.01)
*B65H 43/02* (2006.01)

(52) U.S. Cl.
CPC ..... *G03G 15/5008* (2013.01); *B65H 43/02* (2013.01); *B65H 43/06* (2013.01); *G03G 15/5016* (2013.01); *B65H 2220/03* (2013.01); *B65H 2301/1321* (2013.01); *B65H 2301/4212* (2013.01); *B65H 2301/541* (2013.01); *B65H 2511/30* (2013.01); *B65H 2511/31* (2013.01); *B65H 2511/515* (2013.01); *B65H 2513/511* (2013.01); *B65H 2515/112* (2013.01); *B65H 2601/273* (2013.01); *B65H 2801/06* (2013.01); *G03G 2215/00421* (2013.01); *G03G 2215/00949* (2013.01)

(58) Field of Classification Search
CPC ..... G03G 15/5008
USPC ..... 399/167
See application file for complete search history.

(56) References Cited

U.S. PATENT DOCUMENTS

2009/0035005 A1* 2/2009 Tomiyasu ..... G03G 15/5037 399/82
2010/0092189 A1* 4/2010 Shimizu ..... G03G 15/5029 399/43

(Continued)

FOREIGN PATENT DOCUMENTS

JP 2003302875 A 10/2003

*Primary Examiner* — Walter L Lindsay, Jr.
*Assistant Examiner* — Philipmarcus T Fadul
(74) *Attorney, Agent, or Firm* — Rossi, Kimms & McDowell LLP

(57) ABSTRACT

An image forming apparatus that is capable of preventing discharged sheet adhesion while lowering degradation of productivity. A print unit prints an image on a sheet based on a print job. A fixing unit fixes the image primed on the sheet to the sheet. The sheet to which the image is fixed is discharged to a discharge tray. A counter counts discharged sheet number that is the number of sheets discharged to the discharge tray during a continuous print operation. A controller controls the print unit so as to lower productivity that is discharging sheet number per unit time in response to increase in the discharged sheet number counted by the counter and so as to recover the productivity in a case where the sheets discharged to the discharge tray are removed in a state where the productivity is lowered.

18 Claims, 8 Drawing Sheets

(56) References Cited

U.S. PATENT DOCUMENTS

| | | | | |
|---|---|---|---|---|
| 2017/0036879 | A1* | 2/2017 | Tokuma | B65H 43/00 |
| 2017/0305703 | A1* | 10/2017 | Egawa | B65H 31/26 |

* cited by examiner

IMAGE FORMING APPARATUS CHANGING PRODUCTIVITY ACCORDING TO DISCHARGED SHEET NUMBER

BACKGROUND OF THE INVENTION

Field of the Invention

The present invention relates to image forming apparatuses, such as a copying machine, a printer, and a facsimile machine.

Description of the Related Art

In recent years, some image forming apparatuses, such as a copying machine, a printer, and a facsimile machine, discharge and stack printed sheets heated by a fixing device in a high temperature state due to miniaturization of an apparatus, improvement of productivity, etc. In the meantime, a melting point of toner is lowering for saving power. Particularly in a case of double-sided printing, toners of printed sheets stacked up-and-down may printed matter may fuse to each other, so that the printed sheets are adhered. Such a phenomenon is referred to as discharged sheet adhesion (blocking). Separation of adhered sheets may peel off toner.

In order to prevent the discharged sheet adhesion beforehand, a conventional image forming apparatus takes countermeasures, such as reduction of productivity and lowering of a discharge temperature of a printed sheet. For example, Japanese Laid-Open Patent Publication (Kokai) No. 2003-302875 (JP 2003-302875A) discloses a technique that aborts printing or changes print sequence, such as a discharge interval or a process speed, on the basis of a temperature of printed sheets discharged and stacked on a discharge tray that is detected by a temperature sensor provided in the discharge tray.

However, the technique disclosed in the above-mentioned publication is able to prevent the discharged sheet adhesion but causes a new problem that the productivity is lowered.

SUMMARY OF THE INVENTION

The present invention provides an image forming apparatus that is capable of preventing the discharged sheet adhesion while reducing degradation of the productivity.

Accordingly, an aspect of the present invention provides an image forming apparatus comprising a print unit configured to print an image on a sheet based on a print job, a fixing unit configured to fix the image printed on the sheet to the sheet, a discharge tray to which the sheet to which the image is fixed is discharged, a counter configured to count discharged sheet number that is the number of sheets discharged to the discharge tray during a continuous print operation, a controller configured to control the print unit so as to lower productivity that is discharging sheet number per unit time in response to increase in the discharged sheet number counted by the counter and so as to recover the productivity in a case where the sheets discharged to the discharge tray are removed in a state where the productivity is lowered.

According to the present invention, the discharged sheet adhesion is prevented while reducing degradation of the productivity.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
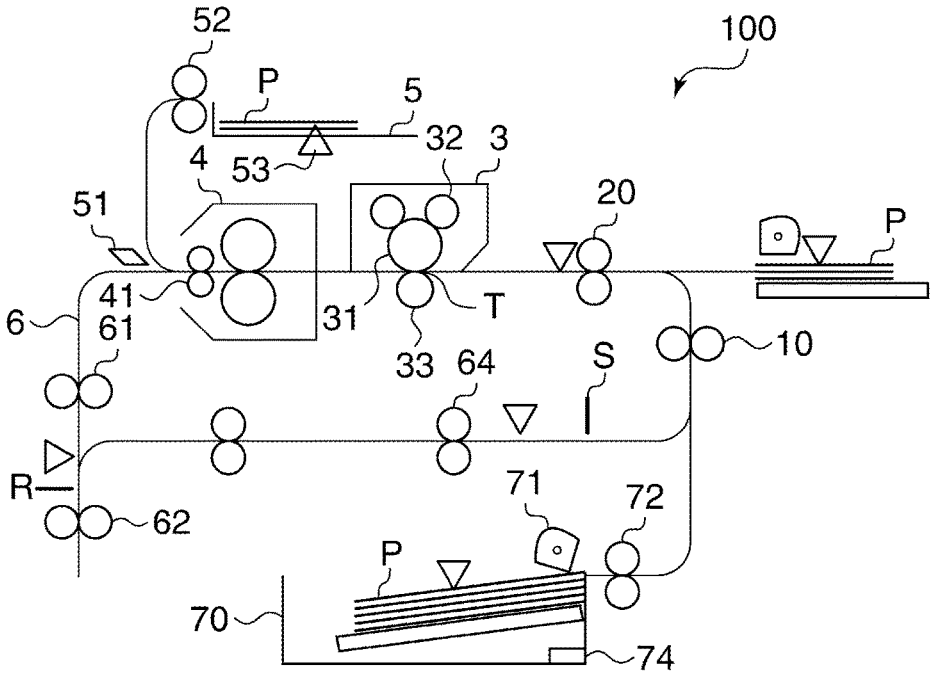
FIG. 1 is a view schematically showing a configuration of an image forming apparatus according to a first embodiment of the present invention.

FIG. 1 is a view schematically showing a configuration of an image forming apparatus according to a first embodiment of the present invention. As shown in FIG. 1, the image forming apparatus is a laser beam printer (hereinafter referred to as a "printer", simply), for example. The printer 100 is provided with an image forming unit 3, a fixing device 4, a discharge unit 5, and a double-sided unit 6. The image forming unit 3 is provided with an image bearing member 31 that rotates at a constant speed, a development device 32 and transfer roller 33 that are arranged so as to face the image bearing member 31. A contact part of the image bearing member 31 and the transfer roller 33 becomes a primary transfer portion T. The transfer roller 33 transfers a toner image on the image bearing member 31 developed with the development device 32 to a sheet P. The fixing device 4 fixes the toner image transferred to the sheet P to the sheet P by heating and pressurizing the sheet P.

A cassette 70 that is a sheet feeding port for feeding the sheet P is arranged in a lower part of the printer 100. The cassette 70 is constituted so as to be freely opened and closed in order to set the sheet P to the cassette 70 concerned. An opening/closing state of the cassette 70 is detected by a cassette opening/closing sensor 74.

The sheet P stored in the cassette 70 is separated and fed one by one by a cassette feed roller 71 and a separation means (not shown). The sheet P fed from the cassette 70 is conveyed by a cassette conveying roller pair 72 and a conveying roller pair 10, and is sent to the registration roller unit 20.

The sheet P sent to a registration roller unit 20 is conveyed to the primary transfer portion T at a timing that synchronizes with the toner image formed on the image bearing member 31 by the registration roller unit 20 and the toner image is transferred to the sheet P concerned at the transfer unit T.

The sheet P to which the toner image was transferred is conveyed to the fixing device 4, and the image is fixed to the sheet P by heating and pressurizing. The sheet P to which the image was fixed is conveyed to a discharge roller pair 52 by a fixing conveying roller pair 41 when a branch flapper 51 is switched to a direction toward a discharge unit 5. The sheet P is discharged by the discharge roller pair 52, and is stacked on the discharge unit 5 in a page order. The sheet P that is discharged and stacked on the discharge unit 5 is detected by a discharged sheet sensor 53.

In a case of double-sided printing, the sheet P to which an image was formed on a first surface thereof is conveyed by the fixing conveying roller pair 41 and is transferred to a double-sided conveying roller pair 61 when a conveyance path is switched to a direction toward a double-sided unit 6 by the branch flapper 51. The sheet P transferred to the double-sided conveying roller pair 61 is conveyed by to a reversing roller pair 62 by the double-sided conveying roller pair 61.

The sheet P conveyed to the reversing roller pair 62 is further conveyed. When the rear end of the sheet P passes over the double-sided conveying roller pair 61 and arrives at a predetermined sheet reversing position R, the reversing roller pair 62 stops. After that, the reversing roller pair 62 is reversed to reverse and convey the sheet P to a re-feeding roller pair 64.

The sheet P conveyed by to the re-feeding roller pair 64 is further conveyed by the re-feeding roller pair 64. When the front end of the sheet P arrives at a paper-re-feeding standby position S, the re-feeding roller pair 64 stops. After that, the re-feeding roller pair 64 restarts at a predetermined timing when the printing to the second surface of the sheet P is enabled. The sheet P is conveyed to the registration roller unit 20 and an image is formed on the second surface in the same manner as the image formation to the first surface.

The sheet P to which the images were formed on the both surfaces thereof is conveyed to the discharge roller pair 52 by rotating the fixing conveying roller pair 41 when the branch flapper 51 is switched to the direction toward the discharge unit 5. After that, the sheet P is discharged to the discharge unit 5 by the discharge roller pair 52.

Next, a control system of the printer 100 will be described.

Figure 2:
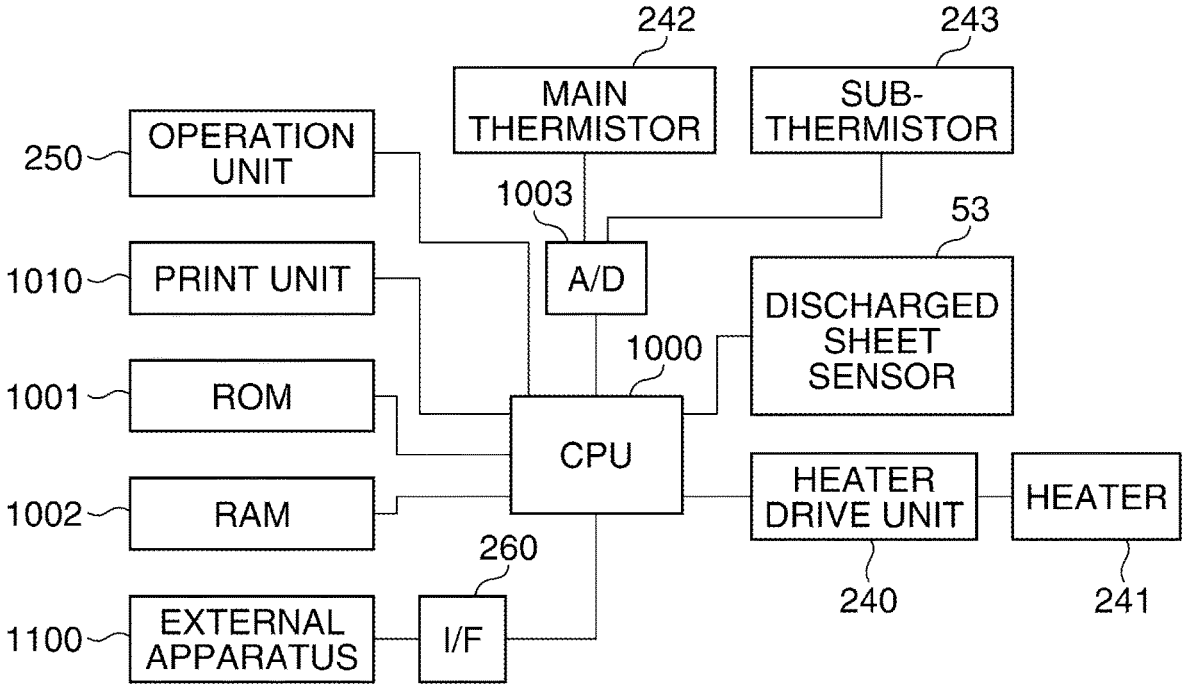
FIG. 2 is a block diagram schematically showing a control system of the image forming apparatus in FIG. 1.

FIG. 2 is a block diagram schematically showing the control system of the printer 100 in FIG. 1.

As shown in FIG. 2, the printer 100 is provided with a CPU 1000 as a controller. The CPU 1000 is connected to the discharged sheet sensor 53, an operation unit 250, a print unit 1010, a ROM 1001, a RAM 1002, and an I/F 260, respectively, and is also connected to an external apparatus 1100 through the I/F 260. Moreover, the CPU 1000 is connected to an A/D converter 1003 and is also connected to a main thermistor 242 and sub-thermistor 243 through the A/D converter 1003. Furthermore, the CPU 1000 is connected to a heater drive unit 240 and is also connected to a heater 241 through the heater drive unit 240.

The I/F 260 consists of USB and LAN. The CPU 1000 receives image data sent from the external apparatus 1100 like a PC through the I/F 260, develops the image data to bit data needed to print, obtains print information (print job), and controls the printer 100.

Figure 3:
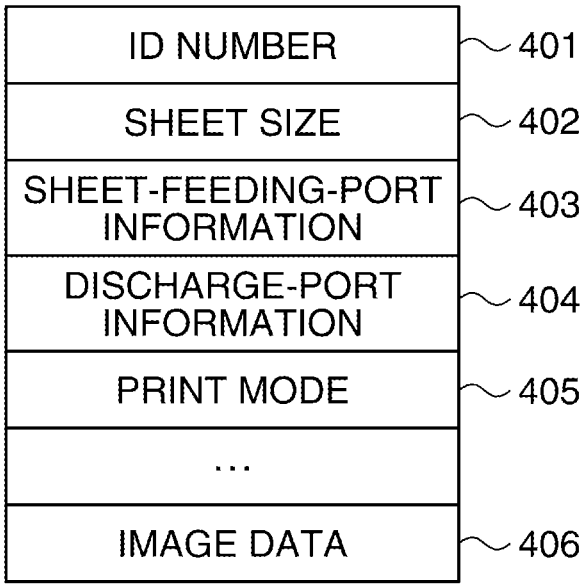
FIG. 3 is a view showing print information that the image forming apparatus receives from an external apparatus.

FIG. 3 is a view showing the print information that the CPU 1000 obtains from the external apparatus 1100. As shown in FIG. 3, the print information is sent as one packet including image data 406 and variety of information about the image data 406 concerned. The CPU 1000 calculates an amount of toner that should be transferred to a sheet (a use amount) on the basis of the image data 406. At this time, the CPU 1000 functions as a toner amount calculation unit. The print information is stored in the RAM 1002 and is used for print control by the CPU 1000.

An ID number 401 is information for identifying image data for every page. A sheet size 402 designates length and width of a sheet that is subjected to printing in millimeters. Sheet-feeding-port information 403 designates a sheet feeding port from which a sheet is fed. Discharge-port information 404 designates a discharge port to which a printed sheet is discharged.

A print mode 405 is prepared for designating control corresponding to a basis weight ($g/m^2$) of a sheet or a type of a sheet. The print mode is selected from among a thin paper mode, normal paper mode, thick paper mode, coat paper mode, etc. A print job using thick paper or coat paper tends to cause discharged sheet adhesion in comparison with a print job using normal paper. A user sets up the type of a sheet through the operation unit 250, for example. It should be noted that a mode may be selected according to a determination result of a sensor (sheet determination unit) that is provided to determine a type of a sheet.

Referring back to FIG. 2, the ROM 1001 stores a program for controlling the printer 100. When the printer is controlled, the RAM 1002 is used to read and write processing data. The print unit 1010 controls loads, such as a sheet conveyance system, a series of high voltage systems for charging, developing, and transferring, an optical system including a scanner motor and laser source, according to instructions from the CPU 1000. Moreover, the print unit 1010 detects operation states of these loads. The CPU 1000 checks a breakdown of each of the loads on the basis of the operation states detected in the print unit 1010 according to a predetermined condition.

The heater drive unit 240, heater 241, main thermistor 242, and sub-thermistor 243 are components of the fixing device 4. The heater drive unit 240 controls electricity of the heater 241 according to instructions from the CPU 1000. The main thermistor 242 and the sub-thermistor 243 detect temperature of the fixing device 4. The detection results of the main thermistor 242 and the sub-thermistor 243 are used for fixing control of the printer unit 1010. The discharged sheet sensor 53 detects whether the sheet P is loaded on the discharge unit 5. The operation unit 250 is used to display the print information and a progress state, and to set up various conditions of the printer.

Next, a print process executed by the printer 100 in FIG. 1 will be described.

Figure 4:
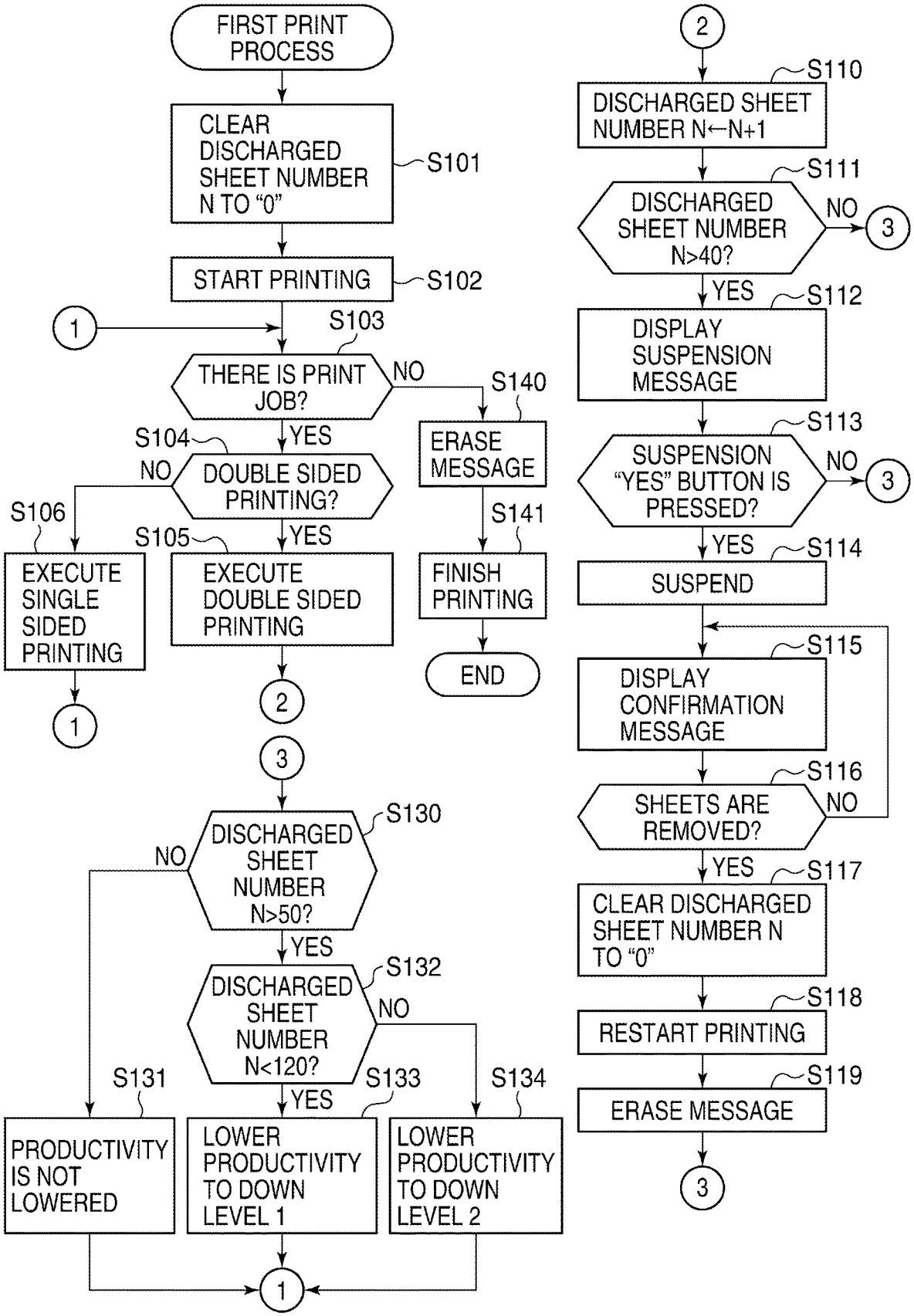
FIG. 4 is a flowchart showing procedures of a first print process executed by the image forming apparatus in FIG. 1.

FIG. 4 is a flowchart showing procedures of a first print process executed by the printer 100 in FIG. 1. The CPU 1000 executes this print process on the basis of a first-print-process program stored in the ROM 1001.

As shown in FIG. 4, the CPU 1000 receives a print job from the external device 1100 through the I/F 260. When starting the received print job, the CPU 1000 first clears a discharged sheet number N recorded in the RAM 1002 to "0" (step S101). It should be noted that the discharged sheet number N indicates a counted value of the number of sheets discharged continuously. Alternatively, the number of continuously printed sheets may be counted instead of the discharged sheet number. After clearing the discharged sheet number N to "0" (step S101), the CPU 1000 starts printing (step S102). That is, the CPU 1000 first determines whether there is an unprocessed print job (step S103). As a result of the determination in the step S103, when there is an unprocessed print job ("YES" in the step S103), the CPU 1000 proceeds with the process to step S104.

The CPU 1000 determines whether the print mode in the print job concerned is a double-sided printing mode (the step S104). As a result of the determination in the step S104, when the print mode is not the double-sided printing mode but a single-sided printing mode ("NO" in the step S104), the CPU 1000 executes single-sided printing (step S106), and returns the process to the step S103 after that.

In the meantime, as a result of the determination in the step S104, when the print mode is the double-sided printing mode ("YES" in the step S104), the CPU 1000 executes double-sided printing (step S105). After executing the double-sided printing (the step S105), the CPU 1000 proceeds with the process to step S110 and increments the discharged sheet number N by one.

Next, the CPU 1000 determines whether the discharged sheet number N exceeds "40" (step S111).

It should be noted that the discharging sheet number per unit time (it is called productivity) is lowered when the discharged sheet number N exceeds a first predetermined value "50" that is a threshold, for example, in order to prevent discharged sheet adhesion. Accordingly, when the discharged sheet number N exceeds "40" that is fewer than the first predetermined value "50", a message is displayed. However, the value "40" and the first predetermined value "50" may be changed according to the toner use amount that the CPU 1000 calculates and the type of the printing sheet. It should be noted that the first predetermined value "50" is smaller than the maximum number of sheets that are allowed to be stacked on a discharge tray. As a result of the determination in the step S111, when the discharged sheet number N exceeds "40" ("YES" in the step S111), the CPU 1000 proceeds with the process to step S112. That is, the CPU 1000 displays a message showing that removal of sheets stacked on the discharge tray (the discharge unit 5) avoids lowering the discharging sheet number per unit time (productivity) on the display screen of the operation unit 250 (step S112).

Figure 5A:
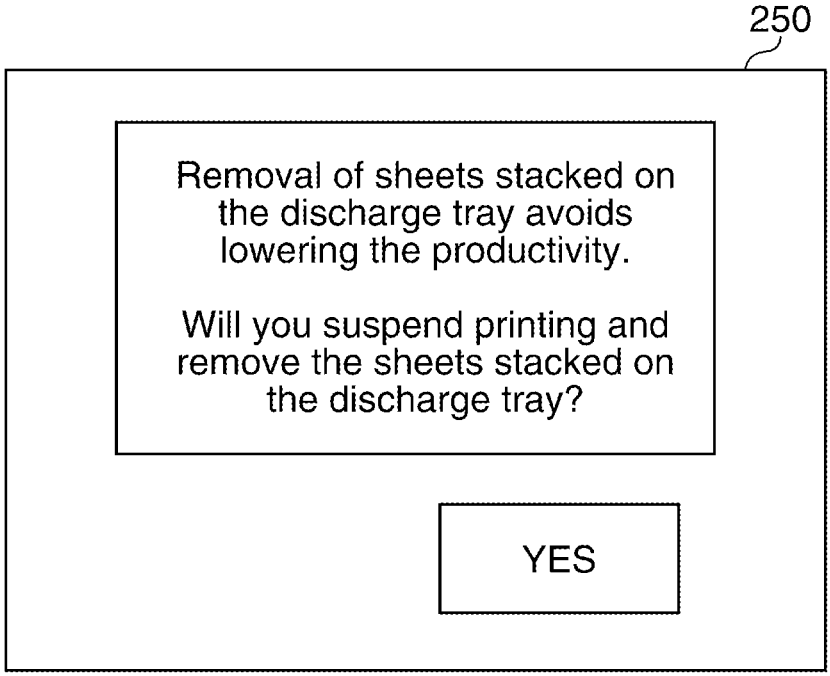
FIG. 5A and FIG. 5B are views showing message screens displayed on an operation unit of the image forming apparatus in FIG. 1.
Figure 5B:
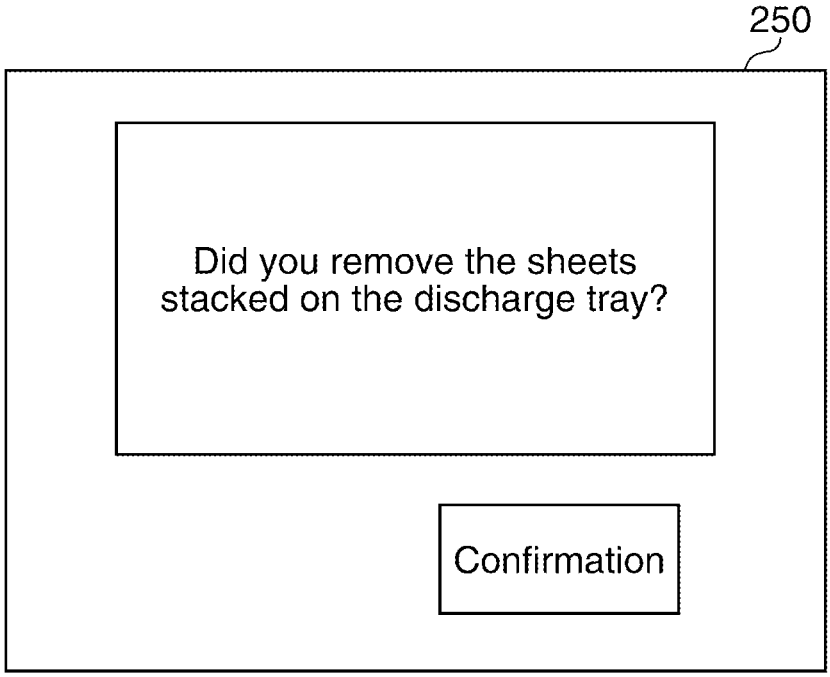

FIG. 5A and FIG. 5B are views showing messages displayed on the display screen of the operation unit 250. As shown in FIG. 5A, the message of "Removal of sheets stacked on the discharge tray avoids lowering the productivity. Will you suspend printing and remove the sheets stacked on the discharge tray?" and a "YES" button are displayed. That is, the message that prompts a user to remove the sheets on the discharge tray is displayed. After displaying the message on the display screen (the step S112), the CPU 1000 determines whether the "YES" button in FIG. 5A is pressed by the user (step S113). This enables to check user's intention of whether the user will remove the sheets on the discharge tray.

As a result of the determination in the step S113, when the "YES" button is pressed ("YES" in the step S113), the CPU 1000 suspends print operation (step S114). Suspension of the print operation facilitates the removal of the sheets discharged and stacked on the discharge tray by the user. When the "YES" button in FIG. 5A is not pressed until the print job is completed, the suspension message in FIG. 5A is erased in step S140 mentioned later at the time when all the print jobs are completed.

After suspending the print operation (the step S114), the CPU 1000 displays a message for checking whether the sheets on the discharge tray have been removed on the display screen of the operation unit 250 (step S115). FIG. 5B shows a message screen for checking whether the sheets on the discharge tray have been removed. A message of "Did you remove the sheets stacked on the discharge tray?" and a "Confirmation" button are displayed. When removing the sheets on the discharge tray, the user presses the "Confirmation" button.

Next, the CPU 1000 determines whether the "Confirmation" button in FIG. 5B is pressed (i.e., whether the sheets P are removed (step S116)) and waits until the sheets are removed (i.e., until the "Confirmation" button is pressed).

After that, when the sheets P are removed and the "Confirmation" button is pressed ("YES" in the step S116), the CPU 1000 clears the discharged sheet number N stored in the RAM 1002 to "0" (step S117). Next, the CPU 1000 restarts printing (step S118) and erases the message displayed on the display screen (step S119).

After eliminating the message displayed on the display screen (the step S119), the CPU 1000 proceeds with the process to step S130 and determines whether the discharged sheet number N exceeds "50" (the step S130). At this time, since the sheets P on the discharge tray are removed in the step S116 and the discharged sheet number N is cleared to "0" in the step S117, the discharged sheet number N becomes "50" or less ("NO" in the step S130). Accordingly, the CPU 1000 proceeds with the process to step S131, continues the print job without lowering the productivity (step S131), and returns the process to the step S103 after that.

In the meantime, as a result of the determination in the step S111, when the discharged sheet number N is not more than "40" ("NO" in the step S111), the CPU 1000 proceeds with the process to step S130. That is, the CPU 1000 determines whether the discharged sheet number N exceeds "50" (step S130). At this time, since the discharged sheet number N is not more than "40", the determination in the step S130 is "NO". Accordingly, the CPU 1000 proceeds with the process to the step S131, continues the printing without lowering the productivity, and returns the process to the step S103.

Moreover, as a result of the determination in the step S113, the "YES" button is not pressed ("NO" in the step S113), the CPU 1000 proceeds with the process to the step S130 and determines whether the discharged sheet number N exceeds "50" (step S130). Hereinafter, the steps S130, S131, S103 through S105, S110 through S113, and S130 are repeated, and the discharged sheet number N increases one by one in the step S110.

When the discharged sheet number N exceeds "50", the determination in the step S130 becomes "YES". Then, the CPU 1000 proceeds with the process to step S132 and determines whether the discharged sheet number N is less than "120" (the step S132). As a result of the determination in the step S132, when the discharged sheet number N is less than "120" ("YES" in the step S132), the CPU 1000 lowers the productivity to a first productivity down level (step S133), and then, returns the process to the step S103 to continue the print job.

In the meantime, as a result of the determination in the step S132, when the discharged sheet number N becomes "120" or more ("NO" in the step S132), the CPU 1000 proceeds with the process to step S134 and lowers the productivity to a second productivity down level. The second productivity down level (second level) is lower in the productivity (smaller in the discharging sheet number per unit time) than the first productivity down level (first level). When the number of stacked sheets P increases because the sheets are not removed from the discharge tray, the productivity should be lowered more in order to prevent from causing the discharged sheet adhesion.

Figure 6A:
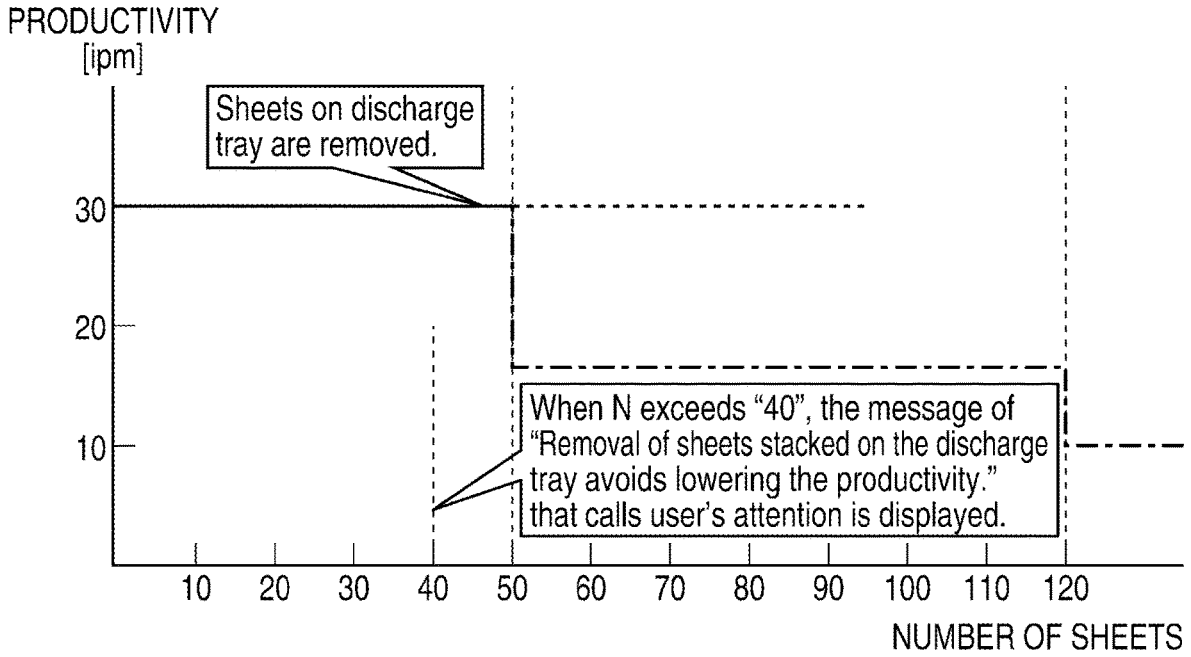
FIG. 6A and FIG. 6B are timing charts respectively showing examples of variations of the productivity of the image forming apparatuses according to the first and second embodiments.

FIG. 6A is a timing chart showing an example of a variation of the productivity of the printer in FIG. 1.

As shown in FIG. 6A, when the discharged sheet number N exceeds "40" during the print job that started in the productivity of 30 ipm (image/minute), the message shown in FIG. 5A is displayed. If the sheets P is removed from the discharge tray at this time point, the productivity of 30 ipm is maintained. In the meantime, when the printing continues without removing the sheets P from the discharge tray, the productivity of the print job that started in the productivity of 30 ipm is lowered to 18 ipm (the first productivity down level) at the time point when the discharged sheet number N exceeds "50". Furthermore, when the discharged sheet number N becomes "120" or more without removing the sheets, the productivity is lowered to 10 ipm (the second productivity down level). It should be noted that the sheet number that is the threshold used for changing the productivity in FIG. 6A varies according to print conditions, such as a sheet type and a toner use amount.

Referring back to FIG. 4, as a result of the determination in the step S103, when there is no unprocessed print job ("NO" in the step S103), the CPU 1000 erases the message displayed on the display screen of the operation unit 250 (the step S140) and finishes the printing (step S141).

According to the process in FIG. 4, the message showing that "removal of sheets stacked on the discharge tray avoids lowering the productivity" is displayed for the user before the discharged sheet number N reaches the first predetermined value to prevent the discharged sheet adhesion (step S112). The user is able to do the print process while preventing the discharged sheet adhesion without lowering the productivity by removing the sheets P on the discharge tray according to the message. That is, when the user removes the sheets P on the discharge tray according to the message at the time point when the discharged sheet number N exceeds "40", for example, before the discharged sheet number N reaches the first predetermined value "50", the print job continues while maintaining the initial productivity that is 30 ipm, for example.

Moreover, according to the first embodiment, since it is not necessary to provide an incidental facility like a sheet cooling fan in the discharge tray (discharge unit 5), there is no special cost increase for preventing the discharged sheet adhesion, which prevent the size of the apparatus from increasing.

In the first embodiment, when a user does not remove the sheets P at the time point when the discharged sheet number N exceeds the first predetermined value, the productivity is lowered once when the discharged sheet number N exceeds "50" (the first predetermined value), for example. Moreover, when the discharged sheet number N became more than "120" (the second predetermined value) that is a threshold, for example, the productivity is further lowered. If the user removes the sheets P, the productivity will be recovered after that. This minimizes the degradation of productivity while preventing the discharged sheet adhesion.

In the first embodiment, a print job is a print job in the double-sided printing mode, for example. Although the double-sided printing mode tends to cause the discharged sheet adhesion because the toner of the sheets discharged to the discharge tray directly contact, the first embodiment is effective even for such a case.

Next, a second embodiment of the present invention will be described.

A hardware configuration of an image forming apparatus according to the second embodiment is identical to the hardware configuration of the image forming apparatus according to the first embodiment.

Figure 7:
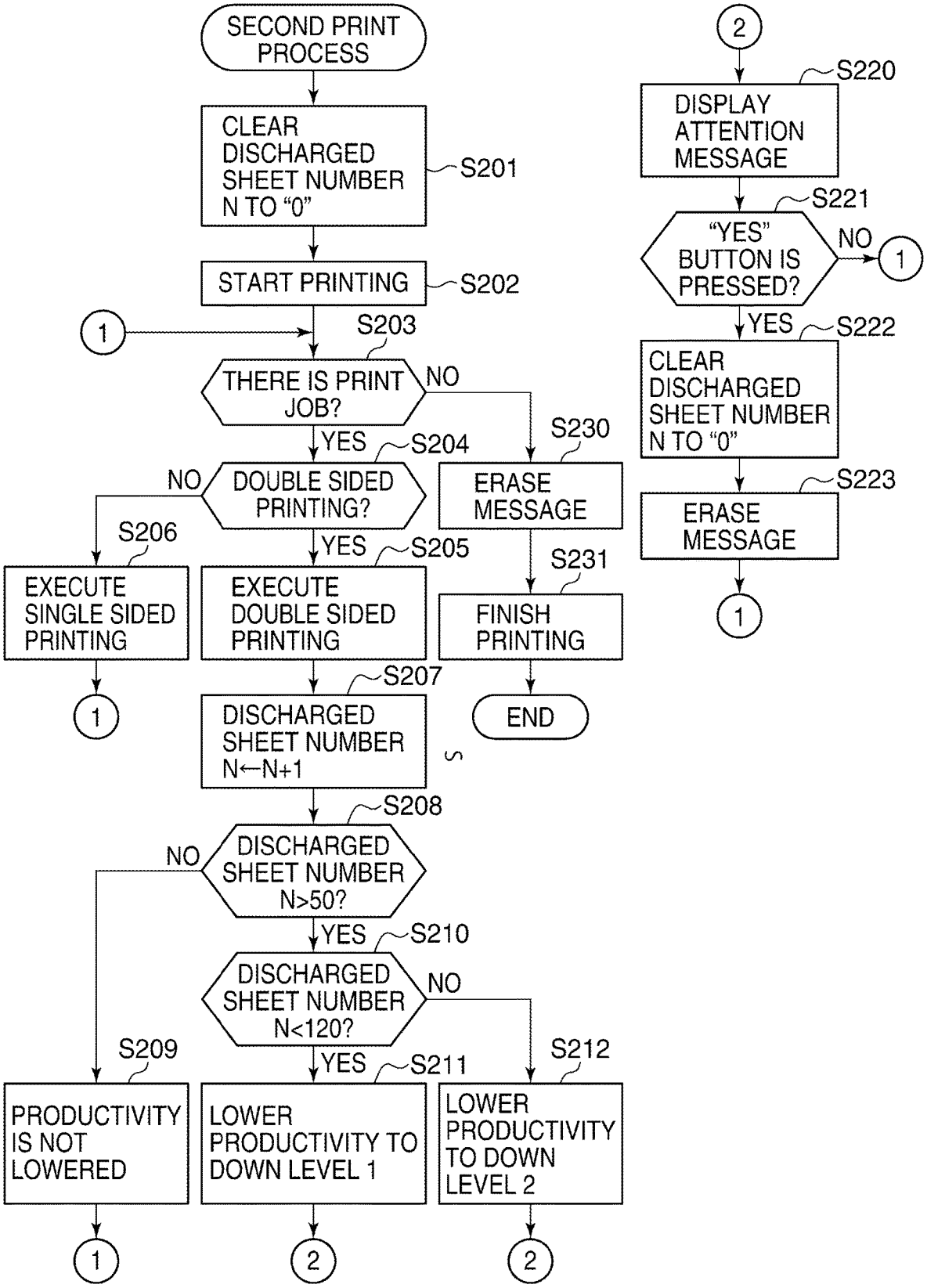
FIG. 7 is a flowchart showing a second print process executed by the image forming apparatus according to the second embodiment of the present invention.

FIG. 7 is a flowchart showing procedures of a second print process executed by the image forming apparatus according to the second embodiment. The CPU 1000 executes this print process on the basis of a second-print-process program stored in the ROM 1001. This print process displays a message that calls for attention after lowering the productivity to prevents discharged sheet adhesion so that the lowered productivity is recovered in response to a user's operation.

As shown in FIG. 7, the CPU 1000 receives a print job from the external device 1100 through the I/F 260. When starting the received print job, the CPU 1000 first clears the discharged sheet number N recorded in the RAM 1002 to "0" (step S201). After clearing the discharged sheet number N to "0" (step S201), the CPU 1000 starts printing (step S202). That is, the CPU 1000 first determines whether there is an unprocessed print job (step S203). As a result of the determination in the step S203, when there is a print job ("YES" in the step S203), the CPU 1000 proceeds with the process to step S204.

The CPU 1000 determines whether the print mode in the print job concerned is the double-sided printing mode (the step S204). As a result of the determination in the step S204, when the print mode is not the double-sided printing mode but the single-sided printing mode ("NO" in the step S204), the CPU 1000 executes the single-sided printing (step S206), and returns the process to the step S203 after that.

In the meantime, as a result of the determination in the step S204, when the print mode is the double-sided printing mode ("YES" in the step S204), the CPU 1000 executes the double-sided printing (step S205). After executing the double-sided printing (the step S205), the CPU 1000 increments the discharged sheet number N by one (step S207).

Next, the CPU 1000 determines whether the discharged sheet number N exceeds "50" (step S208). It should be noted that the first predetermined value "50" may be changed according to the toner use amount that is calculated by the CPU 1000.

As a result of the determination in the step S208, when the discharged sheet number N does not exceed "50" ("NO" in the step S208), the CPU 1000 prints without lowering the productivity (step S209) and returns the process to the step S203 after that.

In the meantime, as a result of the determination in the step S208, when the discharged sheet number N exceeds "50" ("YES" in the step S208), the CPU 1000 proceeds with the process to step S210 and determines whether the discharged sheet number N is less than "120" (step S210). As a result of the determination in the step S210, when the discharged sheet number N is less than "120" ("YES" in the step S211), the CPU 1000 lowers the productivity to the first productivity down level (step S211), and then, returns the process to the step S220.

Moreover, as a result of the determination in the step S210, when the discharged sheet number N is "120" or more ("NO" in the step S210), the CPU 1000 lowers the productivity to the second productivity down level (step S212) and proceeds with the process to the step S220 after that. It should be noted that the second productivity down level is set to lower the productivity rather than the first productivity down level.

In the step S220, the CPU 1000 displays a message showing that "removal of sheets stacked on the discharge tray raises the productivity" so as to call user's attention on the display screen of the operation unit 250.

Figure 8:
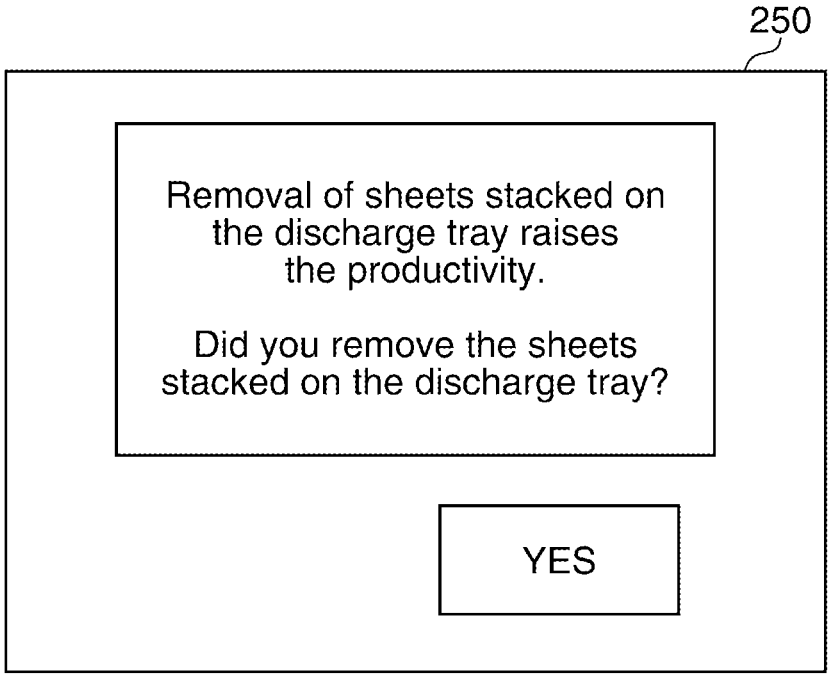
FIG. 8 is a view showing the message screen displayed on the operation unit of the image forming apparatus according to the second embodiment.

FIG. 8 is a view showing a message screen displayed on the operation unit. As shown in FIG. 8, a message showing that "removal of sheets stacked on the discharge tray raises the productivity" and the "YES" button for confirming that the sheets on the discharge tray have been removed are displayed.

After displaying the message, the CPU 1000 determines whether the "YES" button is pressed in the display screen in FIG. 8 (step S221). As a result of the determination in the step S221, when the "YES" button is pressed ("YES" in the step S221), the CPU 1000 clears the discharged sheet number N to "0" (step S222). Then, the CPU 1000 erases the message displayed on the display screen (step S223) and returns the process to the step S203 again after that.

In the meantime, as a result of the determination in the step S221, when the "YES" button is not pressed ("NO" in the step S221), the CPU 1000 returns the process to the step S203 and determines whether there is a print job.

As a result of the determination in the step S203, when there is no print job ("NO" in the step S203), the CPU 1000 erases the message displayed on the display screen (the step S230) and finishes the print operation (step S231). The message erased in the step S230 is displayed in the step S220.

According to the process in FIG. 7, when the discharged sheet number N exceeds the first predetermined value "50", the productivity is lowered to the first productivity down level (step S211). Moreover, when the discharged sheet number N reaches the second predetermined value "120", the productivity is lowered to the second productivity down level (step S212).

In the meantime, when the sheets P on the discharge tray are removed according to the message that calls for attention after lowering the productivity ("YES" in the step S221), the discharged sheet number N is cleared to "0", and then, the lowered productivity is recovered to the state earlier than lowering (the step S208 to S209).

Figure 6B:
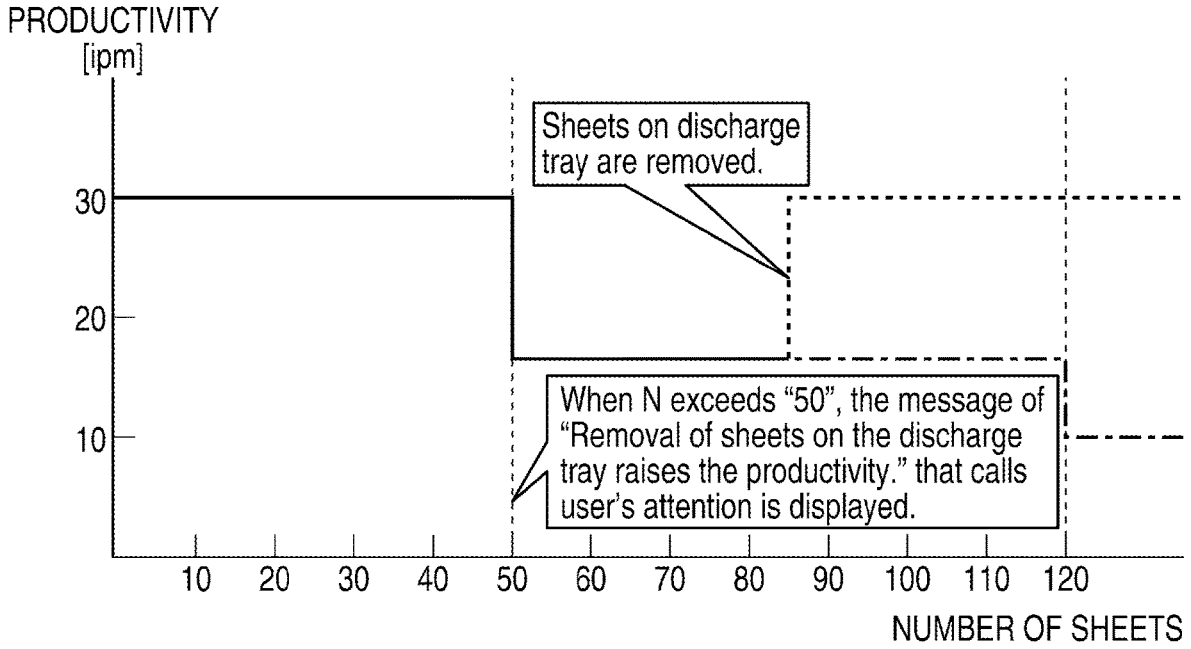

FIG. 6B is a timing chart showing an example of a variation of the productivity in the second embodiment. As shown in FIG. 6B, when the discharged sheet number N exceeds "50" during the print job that started in the productivity of 30 ipm (image/minute) and continues without removing the sheets P from the discharge tray, the productivity is lowered to 18 ipm. The message shown in FIG. 8 is displayed at this time point. Furthermore, when the discharged sheet number N reaches "120", the productivity is lowered to 10 ipm. In the meantime, when the sheets P are removed from the discharge tray after lowering the productivity from 30 ipm to 18 ipm, the productivity is recovered from 18 ipm to 30 ipm.

As mentioned above, according to the second embodiment, the removal of the sheets P stacked on the discharge tray recovers the productivity to the initial productivity 30 ipm even when the productivity is once lowered at the time point when the discharged sheet number N exceeds "50" to prevent the discharged sheet adhesion. This prevents the discharged sheet adhesion while minimizing degradation of the productivity. Moreover, there is a merit that user's stress resulting from the lowered productivity is reduced.

It should be noted that a user cannot know that the productivity is lowered for countermeasure against the discharged sheet adhesion in a conventional apparatus. Moreover, since a user did not know a solution for the discharged sheet adhesion, a print operation continues in a state where the productivity is lowered. The second embodiment improves the productivity by avoiding such inconvenience.

Moreover, although the process (the steps S113 and S114 in FIG. 4) that suspends the print operation is provided in the above-mentioned first embodiment, the process that suspends the print operation is not contained in the second embodiment. That's because the productivity has been lowered in the step S211 or S212 in order to prevent the discharged sheet adhesion at the time point when the process proceeds to the step S221. Accordingly, a user removes the sheets P easily even if the print operation is not suspended. Accordingly, the process to suspend a print operation is omitted.

Next, a third embodiment of the present invention will be described.

The image forming apparatus according to the third embodiment uses the discharged sheet sensor 53 provided in the discharge unit 5 for controlling the productivity.

Figure 9:
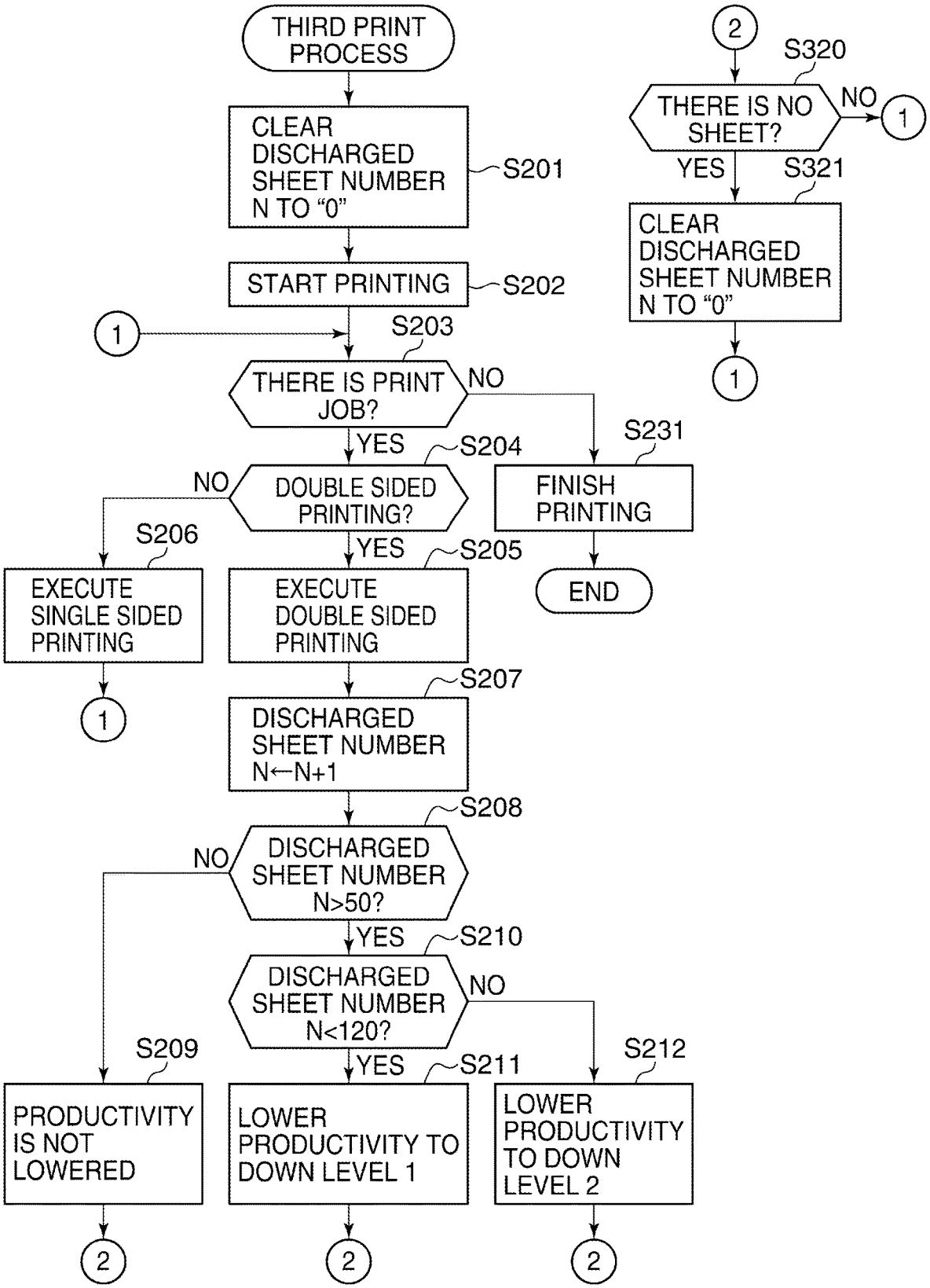
FIG. 9 is a flowchart showing a third print process executed by an image forming apparatus according to a third embodiment of the present invention.

FIG. 9 is a flowchart showing procedures of a third print process executed by in the third embodiment. The CPU 1000 executes this print process on the basis of a third-print-process program stored in the ROM 1001. This print process adjusts the level of the productivity using the detection result of the discharged sheet sensor 53 provided in the discharge unit 5.

As with the second embodiment, the CPU 1000 receives a print job from the external device 1100 through the I/F 260. Next, the CPU 1000 starts the received print job.

A procedure in FIG. 9 that is similar to the procedure in the second print process (FIG. 7) is represented by a step number that is identical to the step number in FIG. 7. Hereinafter, the third print process will be described focusing on a point (steps S320 through S321) different from the second print process.

As a result of the determination in the step S208, when the level of the productivity is not lowered (the step S209), the CPU 1000 proceeds with the process to the step S320. Moreover, when the productivity is lowered to the first productivity down level (the step S211) or the second productivity down level (the step S212) through the determinations in the steps S208 and S210, the CPU 1000 proceeds with the process to the step S320.

Then, the CPU 1000 determines whether there is no sheet P on the discharge tray on the basis of the detection result of the discharged sheet sensor 53 provided in the discharge tray in the step S320. As a result of the determination in the step S320, when there is no sheet P on the discharge tray ("YES" in the step S320), the CPU 1000 clears the discharged sheet number N to "0" (step S321) and returns the process to the S203 after that.

In the meantime, as a result of the determination in the step S320, when there are the sheets P on the discharge tray ("NO" in the step S320), the CPU 1000 returns the process to the step S203 as-is without clearing the discharged sheet number N to "0".

When the detection result of the discharged sheet sensor 53 provided in the discharge tray shows that there is no sheet ("YES" in the step S320), the discharged sheet number N is cleared to "0" in the step S321 according to the process in FIG. 9. In this case, it is determined that the discharged sheet number N becomes "50" or less in the step S208. Accordingly, the print operation continues without lowering the productivity in this case (the step S209). Moreover, the determination that there is no sheet in the step S320 after once lowering the productivity through the step S211 or S212 means that the user removes the sheets on the discharge tray after lowering the productivity. Accordingly, the CPU 1000 continues the print job after recovering the productivity to the initial level on the basis of the detection result of the discharged sheet sensor 53 in this case.

In the meantime, when the user does not remove the sheets P from the discharge tray, the productivity is lowered (the steps S211 and S212) in order to prevent the discharged sheet adhesion.

As mentioned above, the discharged sheet sensor 53 detects whether the sheets P are removed from the discharge tray, and the productivity is controlled on the basis of the detection result in the third embodiment. This facilitates the determination of whether the sheets P are removed from the discharge tray and enables to control the productivity appropriately, which prevents the discharged sheet adhesion beforehand while minimizing the degradation of the productivity.

It should be noted that removal of sheets stacked on the discharge tray by a user is a part of a series of actions in the print operation Accordingly, the third embodiment reduces the degradation of the productivity accompanying the countermeasure against the discharged sheet adhesion because a user removes the sheets on the discharge tray without any special consciousness. Moreover, both the keeping of the productivity and the prevention of the discharged sheet adhesion are achieved without increasing cost by the simple method of removing the sheets on the discharge tray by a user.

Moreover, since the discharged sheet sensor 53 provided in the discharge tray is not used for checking the removal of sheets in the first and second embodiments, the control methods described in the first and second embodiments are executable even if the discharged sheet sensor 53 is not provided.

Moreover, the discharged sheet sensor 53 that detects the removal of sheets may be used in place of the confirmation button for checking the removal of sheets in the first embodiment. Moreover, the process of the first embodiment may be changed so that the process proceeds to the step S117 when the discharged sheet sensor 53 detects that there is no sheet and when the user presses the confirmation button.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-201952, filed Oct. 18, 2017, which is hereby incorporated by reference herein in its entirety.

What is claimed is:

1. An image forming apparatus comprising:

a print unit configured to print an image on a sheet based on a print job;

a fixing unit configured to fix the image printed on the sheet to the sheet;

a discharge tray to which the sheet to which the image is fixed is discharged;

a counter configured to count printed sheet number, which is the number of sheets printed by the print unit during a continuous print operation;

a display unit configured to display information to a user; and a controller configured to control:

the print unit to lower productivity, which is the printed sheet number per unit time, while keeping discharging the sheet to the discharge tray, in a case where the printed sheet number counted by the counter exceeds a first predetermined value without removing the sheets on the discharge tray; and the display unit to display a message as the information that prompts the user to remove the sheets on the discharge tray so as to not lower the productivity, even when the printed sheet number exceeds the first predetermined value, in a case where the printed sheet number counted by the counter exceeds a second predetermined value that is smaller than the first predetermined value.

2. The image forming apparatus according to claim 1, wherein the controller lowers the productivity to a first level in a case where the printed sheet number exceeds the first predetermined value that is smaller than a maximum number of sheets that are allowed to be stacked on the discharge tray.

3. The image forming apparatus according to claim 2, wherein the controller lowers the productivity to a second level that is lower in the productivity than the first level in a case where the printed sheet number reaches a third predetermined value that is larger than the first predetermined value.

4. The image forming apparatus according to claim 3, further comprising:

a toner amount calculation unit configured to calculate an amount of toner used by the print unit for printing the image to the sheet, wherein the controller changes at least one of the first predetermined value or the second predetermined value according to the amount of toner calculated by the toner amount calculation unit.

5. The image forming apparatus according to claim 3, further comprising:

a sheet determination unit configured to determine a type of the sheet, wherein the controller changes at least one of the first predetermined value or the second predetermined value according to a determination result of the sheet determination unit.

6. The image forming apparatus according to claim 1, wherein the controller controls the print unit to continue the print job without lowering the productivity in a case where the sheets on the discharge tray are removed before the printed sheet number exceeds the first predetermined value.

7. The image forming apparatus according to claim 1, wherein the controller suspends the print job in a case where the user enters information that agrees to remove the sheets on the discharge tray after displaying the message on the display unit.

8. The image forming apparatus according to claim 1, wherein the controller controls the print unit to recover the productivity in a case where the sheets discharged to the discharge tray are removed after lowering the productivity.

9. The image forming apparatus according to claim 1, further comprising:

a sheet sensor that detects a sheet on the discharge tray, wherein the controller clears the discharged sheet number to "0" in a case where the sheet sensor detects no sheet.

10. The image forming apparatus according to claim 9, wherein the controller recovers the productivity in a case where the sheet sensor detects no sheet after lowering the productivity to the first level because the printed sheet number exceeds the first predetermined value.

11. The image forming apparatus according to claim 1, wherein the controller does not execute the control to lower the productivity according to the increase in the printed sheet number in a case where the print job is not a job of a double-sided printing mode that prints images to both sides of a sheet.

12. An image forming apparatus comprising:

a print unit configured to print an image on a sheet based on a print job;

a fixing unit configured to fix the image printed on the sheet to the sheet;

a discharge tray to which the sheet to which the image is fixed is discharged;

a display unit configured to display information to a user;

a counter configured to count a printed sheet number, which is the number of sheets printed by the print unit during a continuous print operation;

a controller configured to control:

in a case where the printed sheet number counted by the counter exceeds a first predetermined value without removing the sheets on the discharge tray, the print unit to lower productivity, which is the printed sheet number per unit time, while keeping discharging the sheet to the discharge tray; and the display unit to display a message as the information that prompts the user to remove the sheets discharged to the discharge tray, even when the number of sheets stacked on the discharge tray is less than a maximum number of sheets that are allowed to be stacked on the discharge tray; and the print unit to recover the productivity from a state where the productivity is lowered in a case where the sheets discharged to the discharge tray are removed after the productivity is lowered.

13. The image forming apparatus according to claim 12, wherein the message includes a first message as the information that the productivity is recovered when the sheets on the discharge tray are removed.

14. The image forming apparatus according to claim 12, further comprising:

a sheet sensor that detects a sheet on the discharge tray, wherein the controller clears the discharged sheet number to "0" in a case where the sheet sensor detects no sheet.

15. The image forming apparatus according to claim 14, wherein the controller recovers the productivity in a case where the sheet sensor detects no sheet after lowering the productivity to a first level due to the printed sheet number exceeding the first predetermined value.

16. The image forming apparatus according to claim 12, further comprising:

a toner amount calculation unit configured to calculate an amount of toner used by the print unit for printing the image to the sheet, wherein the controller changes at least the first predetermined value or the second predetermined value according to the amount of toner calculated by the toner amount calculation unit.

17. The image forming apparatus according to claim 12, further comprising:

a sheet determination unit configured to determine a type of the sheet, wherein the controller changes at least the first predetermined value or the second predetermined value according to a determination result of the sheet determination unit.

18. The image forming apparatus according to claim 12, wherein the controller does not control the print unit to lower the productivity according to the increase in the printed sheet number in a case where the print job is not a job of a double-sided printing mode that prints images to both sides of a sheet.

* * * * *